US011951349B1

(12) United States Patent
Spencer et al.

(10) Patent No.: US 11,951,349 B1
(45) Date of Patent: Apr. 9, 2024

(54) HANDLE SUPPORT DEVICE FOR A BARBELL SHAFT

(71) Applicant: Front Rack LLC, St. Petersburg, FL (US)

(72) Inventors: Norman Spencer, St. Petersburg, FL (US); Austin Hickey, St. Petersburg, FL (US)

(73) Assignee: Front Rack LLC, St. Petersburg, FL (US)

( * ) Notice: Subject to any disclaimer, the term of this patent is extended or adjusted under 35 U.S.C. 154(b) by 175 days.

(21) Appl. No.: 17/725,123

(22) Filed: Apr. 20, 2022

(51) Int. Cl.
*A63B 21/00* (2006.01)
*A63B 21/072* (2006.01)
*A63B 23/04* (2006.01)

(52) U.S. Cl.
CPC ..... *A63B 21/4035* (2015.10); *A63B 21/0724* (2013.01); *A63B 2023/0411* (2013.01)

(58) Field of Classification Search
CPC ..... A63B 21/0724; A63B 21/4035; A63B 2023/0411
See application file for complete search history.

(56) References Cited

U.S. PATENT DOCUMENTS

| | | | | |
|---|---|---|---|---|
| 8,267,841 | B1 * | 9/2012 | Allison | A63B 21/075 482/106 |
| 10,004,970 | B1 * | 6/2018 | Mailander | A63B 21/4035 |
| 10,086,225 | B2 * | 10/2018 | Sheppard | A63B 21/0728 |
| 11,383,123 | B2 * | 7/2022 | Reibman | A63B 21/0724 |
| 2009/0152783 | A1 * | 6/2009 | Sigler | E04H 17/26 269/287 |
| 2009/0203508 | A1 * | 8/2009 | Hauser | A63B 21/4049 482/139 |
| 2011/0173778 | A1 * | 7/2011 | Wales | B25G 3/20 16/426 |
| 2019/0351280 | A1 * | 11/2019 | Klecka | A63B 21/0726 |
| 2019/0351281 | A1 * | 11/2019 | Monarrez, Jr. | A63B 21/4035 |
| 2020/0188723 | A1 * | 6/2020 | Reibman | A63B 21/0724 |

* cited by examiner

*Primary Examiner* — Joshua Lee
(74) *Attorney, Agent, or Firm* — Nicholas Pfeifer; Smith & Hopen, P. A.

(57) ABSTRACT

The present disclosure relates to handle support device for a barbell shaft. The device comprises a handle having a first end and a second end, wherein the first end extends into a U-shaped sleeve, the second end comprises a lip. The first end and the second end are at a pre-defined distance from each other. Moreover, the U-shaped sleeve is configured to releasably lock onto an outer periphery of a barbell shaft such that the handle extends laterally relative to the longitudinal axis of the barbell shaft when the handle is secured to the barbell shaft.

16 Claims, 6 Drawing Sheets

SECTION B-B

HANDLE SUPPORT DEVICE FOR A BARBELL SHAFT

FIELD OF INVENTION

The present invention relates to a handle support and attachment devices. More specifically, it relates to a handle support device for a barbell shaft that helps a lifter perform squat exercises.

BACKGROUND OF INVENTION

In the field of bodybuilding, there are many exercises performed to increase overall body strength and muscle size. Particularly, one of these exercises comprises squats. Squats can be performed to sculpt a strong, toned lower body, by developing the muscles of the legs and glutes, as well as other muscles. Additionally, squats can be performed with individual weights, or weights mounted on a barbell.

One such exercise is a barbell front squat, in which an exerciser places a barbell on the front of his/her shoulders. However, it can be difficult to securely hold the barbell in position when the lifter has limited mobility. This lift can be especially difficult for beginners. Often the lack of mobility can prevent a lifter from maintaining proper posture while executing a front squat, and therefore may result in discomfort and injury. In some scenarios, due to improper posture while performing front squats with barbells, the wrists of the exerciser may get stretched due to the weight of the barbell. This may also result in a wrist injury. Further, there is a potential risk of the exerciser not maintaining balance, which may also cause the barbell to fall from the lifter's grasp.

Therefore, there is a need for a device that allows the exerciser to more easily grip the barbell while performing front barbell squats with correct posture to reduce the chances of accidents and injury.

SUMMARY OF INVENTION

Various objects, features, aspects and advantages of the inventive subject matter will become more apparent from the following detailed description of preferred embodiments, along with the accompanying drawing figures in which like numerals represent like components.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of examples only. An utmost but heretofore unfulfilled need for a handle support device for a barbell shaft is now met by a new, useful and nonobvious invention.

The present invention relates to a handle support and attachment devices. More specifically, it relates to a handle support device for a barbell shaft that helps in performing squat exercises easily.

An aspect of the present disclosure pertains to a handle support device comprising a handle. The handle further comprises a first end and a second end. The first end of the handle extends into a U-shaped sleeve, and the second end comprises a lip. Further, the first end and the second end are at pre-defined distance from each other. The U-shaped sleeve is configured to releasably lock on to an outer periphery of the barbell shaft in such a manner that that the handle support device is perpendicular to a longitudinal axis of the barbell shaft.

In an aspect, the handle support device comprises an inner metal frame. The inner metal frame comprises a plurality of claws on the first end thereof, and the plurality of claws are provided on the free end of the first end of the inner metal frame. Further, a semi-soft material is overmolded on to the inner metal frame to form the handle support device with a grip. The grip may be selected from a group comprising of finger grip, ribbed grip, bubble grip, hex grip, and contour grip. In some embodiments, the grip further comprises a text area having a text embossed on the surface thereof.

In another aspect, the U-shaped sleeve comprises a snap lock. The snap lock is provided towards the free end of the U-shaped sleeve. The snap lock is configured to lock the U-shaped sleeve onto the barbell shaft in a locked state. Further, the snap lock is formed as a protrusion on the free end of the U-shaped sleeve, which protrudes inwards in an inner curvature of the said U-shaped sleeve.

In yet another aspect, the handle support device comprises two handles. The two handles can be spaced at a pre-defined distance from each other on the barbell shaft, the pre-defined distance equivalent to the distance between the shoulders of the exerciser.

BRIEF DESCRIPTION OF THE DRAWINGS

The accompanying drawings are included to provide a further understanding of the present disclosure and are incorporated in and constitute a part of this specification. The drawings illustrate exemplary embodiments of the present disclosure and, together with the description, serve to explain the principles of the present disclosure. The diagrams are for illustration only, which thus is not a limitation of the present disclosure.

For a fuller understanding of the invention, reference should be made to the following detailed description, taken in connection with the accompanying drawings, in which.

DETAILED DESCRIPTION OF THE DRAWINGS

Figure 1:
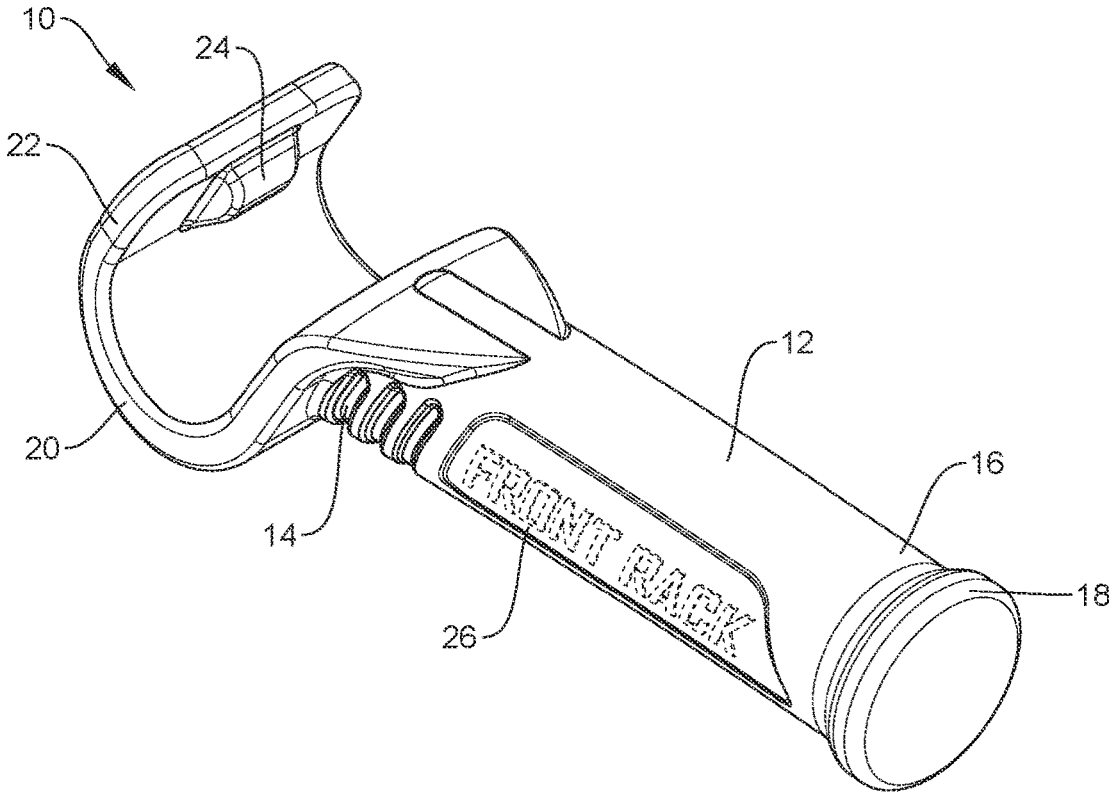
FIG. 1 illustrates a perspective view of a handle support device according to an embodiment of the present invention.

In the following detailed description of the preferred embodiments, reference is made to the accompanying drawings, which form a part thereof, and within which are shown by way of illustration specific embodiments by which the invention may be practiced. It is to be understood that other embodiments may be utilized, and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

Exemplary embodiments will now be described more fully hereinafter with reference to the accompanying drawings, in which exemplary embodiments are shown. This disclosure may, however, be embodied in many different forms and should not be construed as limited to the embodiments set forth herein. These embodiments are provided so that this disclosure will be thorough and complete and will fully convey the scope of the disclosure to those of ordinary skill in the art. Moreover, all statements herein reciting embodiments of the disclosure, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Various terms as used herein are shown below. To the extent a term used in a claim is not defined below, it should be given the broadest definition as persons in the pertinent art have given that term as reflected in printed publications and issued patents at the time of filing.

In the figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

One or more of the problems of the conventional prior art may be overcome by various embodiments of the present invention.

The invention accordingly comprises the features of construction, combination of elements, and arrangement of parts that will be exemplified in the disclosure set forth hereinafter and the scope of the invention will be indicated in the claims.

An exerciser performing a barbell front squat is required to have a means for facilitating proper positioning and to restrict movement of elbows, a locking means to accommodate and lock a barbell shaft in place and enable a proper grip of the barbell shaft without inflicting any damage to wrists, shoulders, and/or fingers while allowing the lifter to overcome mobility issues. The present invention discloses a handle support device configured to attach to a barbell shaft. The handle support device comprises a handle, which an exerciser can grip on one end, and which attaches to the barbell shaft on another end. The handle comprises a sleeve at one end, wherein the sleeve is formed as a hook to accommodate and lock the barbell shaft therein.

FIG. 1 illustrates a perspective view of a handle support device according to the present invention. As depicted in FIG. 1, an embodiment of the handle support device (10) comprises a handle (12), a first end (14) of the handle (12), a second end (16) of the handle (12), a lip (18), a U-shaped sleeve (20), a free end (22) of the U-shaped sleeve (20), a snap lock (24), and a text area (26). The first end (14) and the second end (16) of the handle (12) are spaced apart at a pre-defined distance from each other. In an embodiment, the pre-defined distance between the first end (14) of the handle (12) and the second end (16) of the handle (12) is equivalent to the length of the handle. Further, the length of the handle lies in the range between 140-160 mm, preferably 150 mm.

Figure 2:
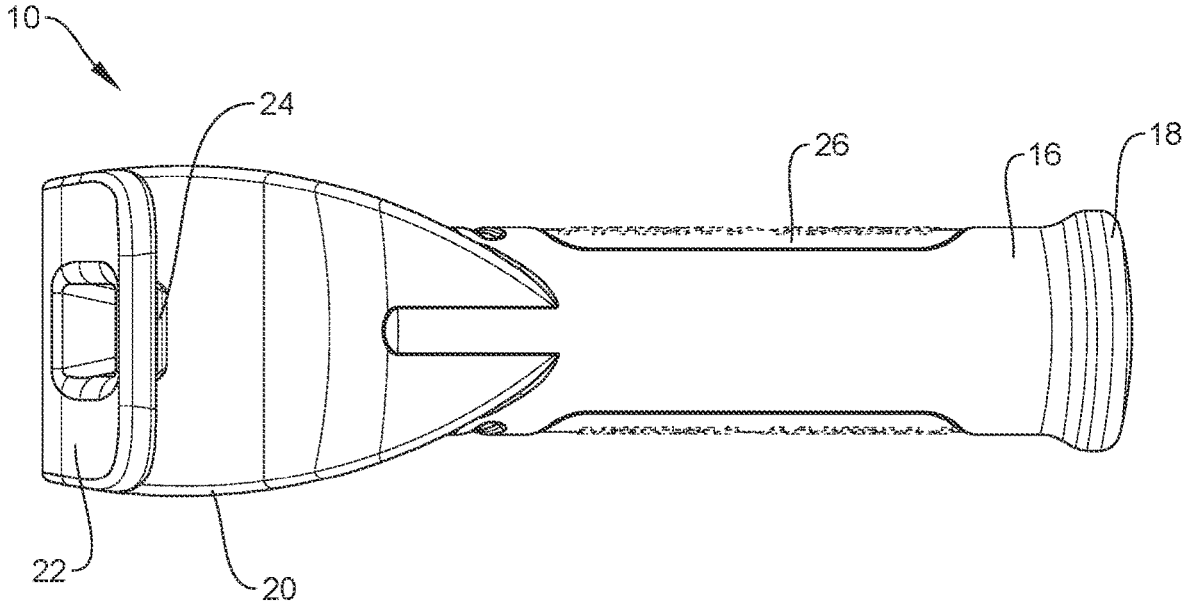
FIG. 2 illustrates a top view of the handle support device according to an embodiment of the present invention.
Figure 3A:
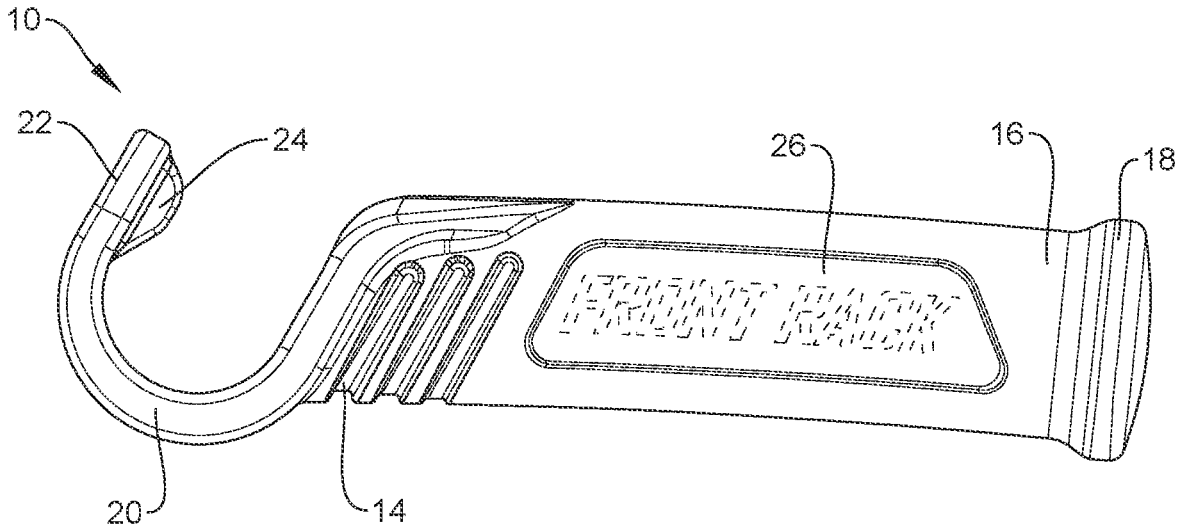
FIG. 3A illustrates a side view of the handle support device according to an embodiment of the present invention.

FIG. 2 illustrates a top view of the handle support device according to the present invention. FIG. 3 illustrates a side view of the handle support device according to the present invention. In an embodiment of the present invention, referring to FIGS. 2 and 3, it is depicted that the first end (14) of the handle (12) extends into the U-shaped sleeve (20). Further, the second end (16) of the handle (12) is provisioned with a lip (18). Further, the handle (12) is provisioned with a grip. Preferably, an exerciser uses the handle support device (10) by gripping the handle (12) with his/her hand, while performing physical activities such as a front barbell squat. While exercising, the lip (18) acts as a stopper and is configured to restrict slipping of the hand along the handle (12), in scenarios when the hand becomes wet due to sweating.

Further, the grip on handle (12) includes features designed to increase friction, including but not limited to finger ridge, ribs, projections, hex patterns, contours, and the like. The grip provides appropriate friction by way of different types of surface features provided by way of different types of grip as discussed above. The grip also ensures no cuts or injury are inflicted onto the fingers and palms of the exerciser during the exercise.

In an embodiment of the present invention, the handle (12) is provisioned with the text area (26). The text area (26) may include a text illustrating a left hand/right hand symbols, brand logo, and/or designs which further enhances the grip of the handle. In an embodiment, the handle (12) is ergonomically designed to provide a strong grip by providing one or more inundations ensuring placement of the fingers and palm of the hands of the exerciser ergonomically.

An embodiment of the present invention further includes the U-shaped sleeve (20) configured to accommodate a typical barbell shaft. The U-shaped sleeve (20) is formed as an extension of the first end (14) of the handle (12) in the form of a hook. Thus, the exerciser can fix the barbell in the handle support device (10) by fixing the barbell shaft in the inner curvature of the U-shaped sleeve (20) in a locked state.

In an embodiment, the U-shaped sleeve (20) comprises the free end (22). The free end (22) is provided with a snap lock (24). The snap lock (24) is provided as a protrusion, protruding towards the inner curvature of the U-shaped sleeve. Further, the snap lock (24) is configured to releasably lock the barbell shaft in the inner curvature of the U-shaped sleeve (20). The U-shaped sleeve may lock on to the outer periphery of the barbell shaft via snap fit, push fit, and the like. Since the barbell shaft is locked within the U-shaped sleeve (20) using a snap lock (24), the falling of the barbell from the shoulders of the exerciser is averted.

Figure 3B:
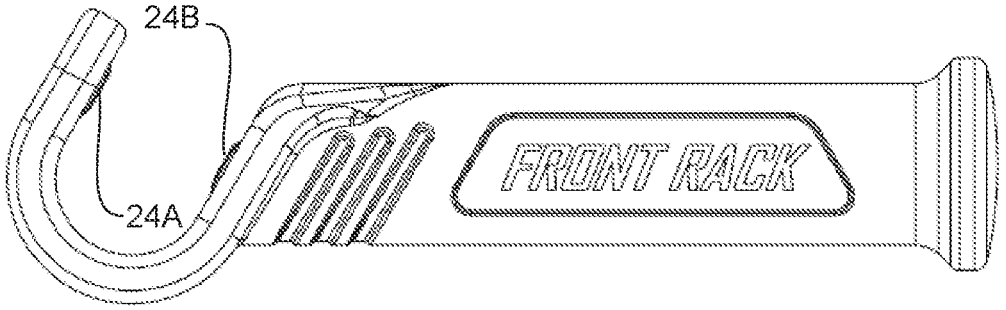
FIG. 3B illustrates a side view of the handle support device according to an embodiment of the present invention.

In some embodiments, as illustrated in FIG. 3B, U-shaped sleeve (20) comprises a first snap lock (24A) proximate the free end (22) and a second snap lock (24B) proximate the start of the U-shaped sleeve (20). The snap locks (24) are provided as a protrusion, protruding towards the inner curvature of the U-shaped sleeve. Further, the snap locks (24) are configured to releasably lock the barbell shaft in the inner curvature of the U-shaped sleeve (20). The U-shaped sleeve may lock on to the outer periphery of the barbell shaft via snap fit, push fit, and the like. Since the barbell shaft is locked within the U-shaped sleeve (20) using a snap locks (24), the falling of the barbell from the shoulders of the exerciser is averted.

In some embodiments, the inner diameter of the U-shaped sleeve lies in the range between 20 mm to 30 mm, preferably 25 mm. Further, in the locked position, the diameter of the U-shaped sleeve is expandable and lies in the range between 25 mm to 35 mm, preferably 30 mm.

In some embodiments, the distance between the snap lock (24) and the opposite side of the U-shaped sleeve, or the distance between the first snap lock (24A) and the second snap lock (24B) is less than the diameter of the barbell. In some embodiments, said distance is less than or equal to 25 mm. In some embodiments, said distance is less than or equal to 28 mm in some embodiments, distance is less than or equal to 30 mm.

In some embodiments, the snap lock (24) which is formed as a protrusion has an outer surface which is provisioned with surface properties (not shown) to increase friction. Non-limiting example include a textured surface, a micro-structure, a graining structure, and the like. The friction between the surfaces prevents the barbell shaft from unintentionally exiting the U-shaped sleeve (20) of the handle support device (10).

Figure 4:
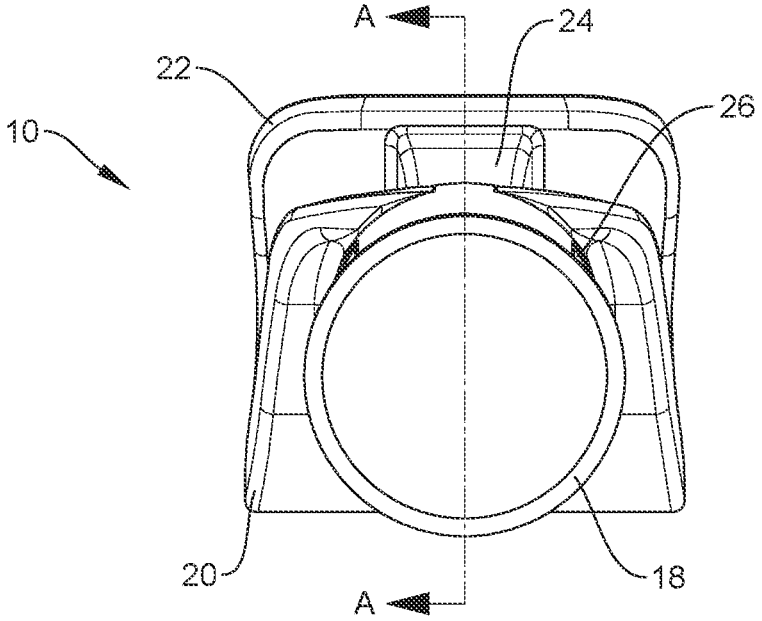
FIG. 4 illustrates a rear view of the handle support device according to an embodiment of the present invention.

FIG. 4 illustrates a rear view of the handle support device (10) according to some embodiments of the present invention. Referring to the FIG. 4, the handle (12) and the U-shaped sleeve (20) of the handle support device (10) are symmetrically aligned along a longitudinal axis AA' passing through the length of the handle support device (10). Further, the handle (12) and the U-shaped sleeve (20) are linearly aligned with each other. As a result, the U-shaped sleeve (20) locks onto the barbell shaft such that the handle (12) is perpendicular to the longitudinal axis of the barbell shaft. In other words, the U-shaped sleeve (20) is oriented with respect to handle (12) such that a 90-degree angle is formed between the handle (12) and the barbell when the handle (12) is attached to the barbell.

In some embodiments, the handle (12) and the U-shaped sleeve (20) of the handle support device (10) are symmetrically aligned along a longitudinal axis AA' passing through the length of the handle support device (10). Rather, the U-shaped sleeve (20) is oriented with respect to handle (12) at a cantered angle such that the angle between handle (12) and the barbell is not 90 degrees when the handle (12) is attached to the barbell.

Figure 5:
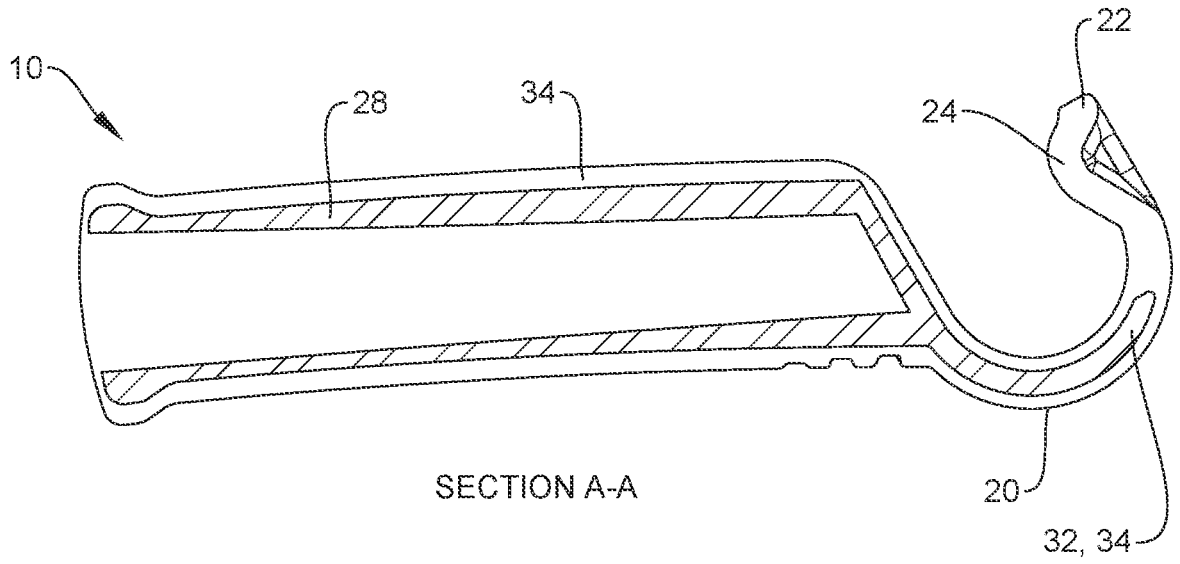
FIG. 5 illustrates a top view of an inner metal frame of the handle support device according to an embodiment of the present invention.

FIG. 5 illustrates a top view of an inner metal frame of the handle support device according to an embodiment of the present invention. Referring to FIG. 5, an inner metal frame (28) of the handle support device (10) is illustrated. Further, the inner metal frame (28) comprises a first end (36) and a second end (38). The inner metal frame (28) is configured to provide structural rigidity to the handle support device (10). Further, the inner metal frame (28) can be forged using metals and alloy of metals selected from but not limited to stainless steel, chromium plated steel, mild steel, and the like.

Figure 6:
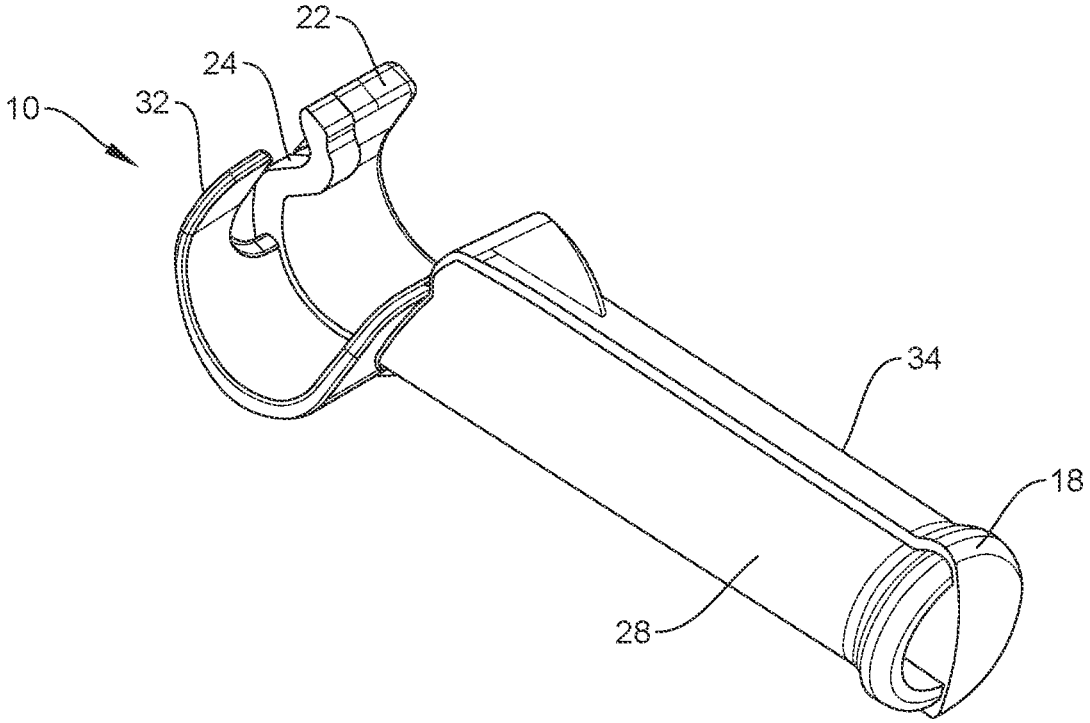
FIG. 6 illustrates a side view of the inner metal frame of the handle support device according to an embodiment of the present invention.

In some embodiments, the first end (36) of the inner metal frame (28) is provisioned with a plurality of claws or fingers (30, 32). As exemplified in FIGS. 5 and 6, the plurality of claws or fingers (30, 32) are formed to open towards a free end of the U-shaped sleeve of the inner metal frame of the handle support device (10). The plurality of claws (30, 32) act as an inner frame for the U-shaped sleeve (20). It must be noted that in an embodiment, the plurality of claws (30, 32) is not limited to form a complete U-shape. The plurality of claws (30, 32) can be shaped as an arc, preferably at a radial length on which the U-shaped sleeve can be supported.

In some embodiments, the first end (36) of the inner metal frame (28) is not provisioned with a plurality of claws or fingers (30, 32). Rather, the first end (36) may simply be a singular curved extension (30) as provided in FIGS. 9 and 10.

Figure 9:
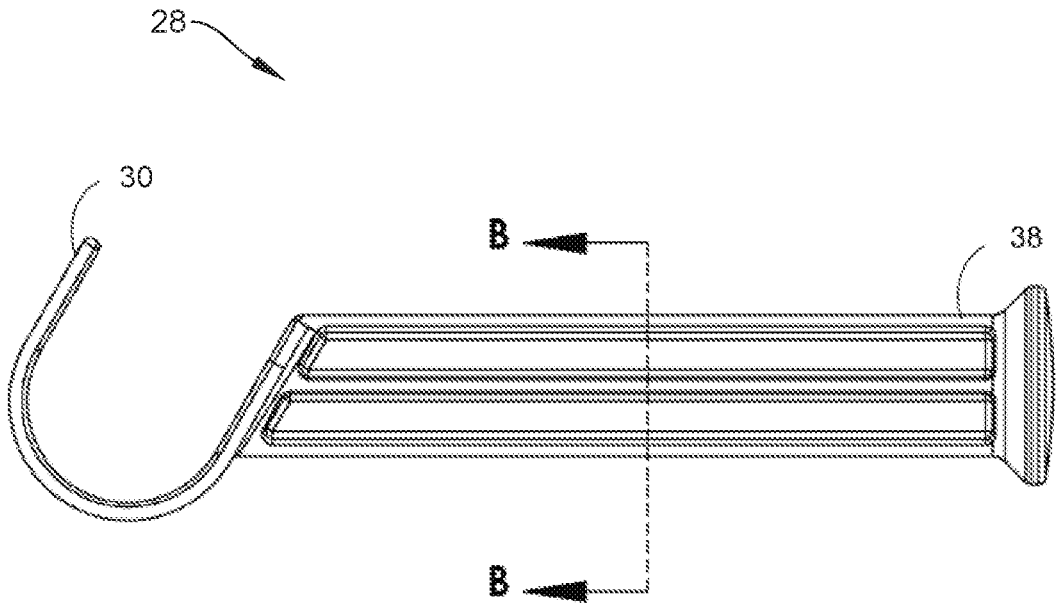
FIG. 9 illustrates a side view of the inner metal frame of the handle support device according to an embodiment of the present invention.
Figure 10:
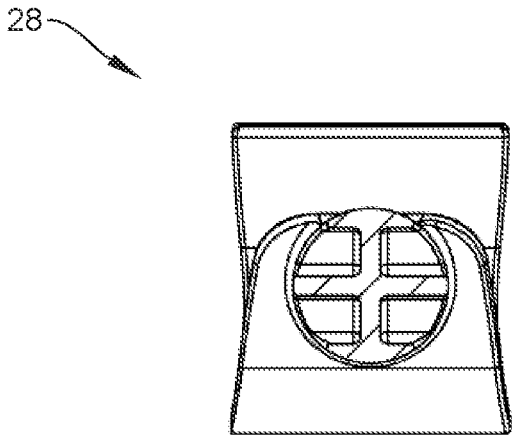
FIG. 10 illustrates a sectional perspective view of the inner metal frame of the handle support device according to an embodiment of the present invention.

In some embodiments, as depicted in FIGS. 9 and 10, the inner metal frame (28) may include a second end (38) having a cross-sectional shape of a plus sign (+). This cross-sectional shape may improve the rigidity of at least the section in which the user grips the handle. Some embodiments may use alternative cross-sectional shaped configured to improve the rigidity of the handle section.

Figure 7:
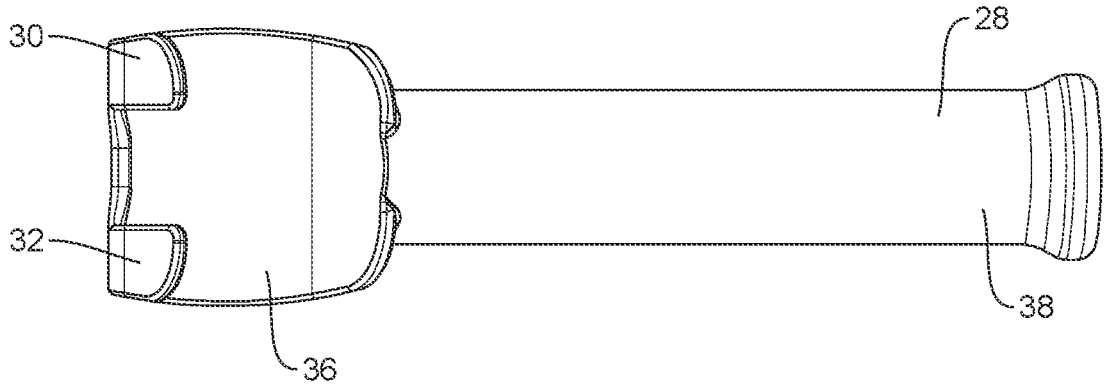
FIG. 7 illustrates a sectional view of the handle support device of the handle support device according to an embodiment of the present invention.
Figure 8:
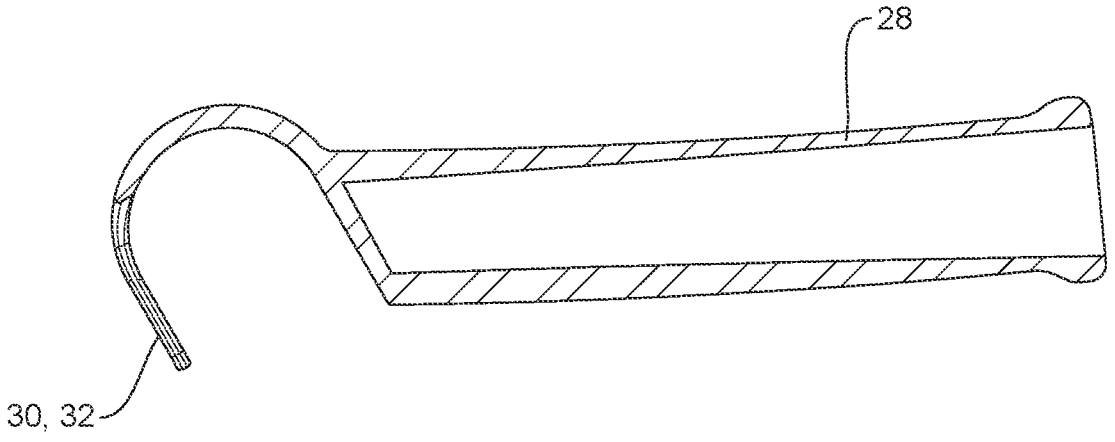
FIG. 8 illustrates a sectional perspective view of the handle support device according to an embodiment of the present invention.

FIG. 7 illustrates a sectional view of the handle support device of the handle support device according to the present invention. FIG. 8 illustrates a sectional perspective view of the handle support device according to the present invention. Referring to FIGS. 7 and 8, a semi-soft material (34) is overmolded on the first end (36) and the second end (38) of the inner metal frame (28) to form a handle support device (10). Further, the semi-soft material (34) is overmolded on the inner metal frame (28) using injection molding. The semi-soft material can be selected from a group comprising but not limited to polyvinyl chloride (PVC), rubber, thermoplastic elastomers (TPE), and the like.

In an embodiment, the grip of the handle (12) can be formed separately by overmolding the second end (38) of the inner metal frame with an additional layer of semi-soft material. Furthermore, an embodiment includes the additional layer of semi-soft material also selected from the group comprising but not limited to polyvinyl chloride (PVC), rubber, thermoplastic elastomers (TPE), and the like.

In an alternative embodiment, an additional soft material (not shown) is further molded on the semi-soft material (34) overmolded on the second end (38) of the inner metal frame (28). In an embodiment, the soft material is embossed to provide a grip for facilitating gripping by the hands of the exerciser. Further, the soft material is selected from the group selected from but not limited to rubber, sponge, silicone, and the like. In an embodiment, the handle (12) may be covered by a grip configured to increase the surface friction of the handle (12).

In an embodiment, an exerciser may hold the barbell over his/her shoulders by attaching two handle support devices (10) to a barbell shaft. The handles (12) of the handle support devices (10) are held in each hand such that the handle support devices (10) are perpendicular to the barbell shaft. Further, the two handle support devices (10) releasably and snapingly lock onto an outer periphery of the barbell shaft. The two handles (12) are preferably spaced at a first pre-defined distance apart from each other. The pre-defined distance separating the two handles (12) may be adjusted according to needs and desires of the exerciser.

In an embodiment, to perform the front squat exercise, the exerciser lifts the barbell while using the two handles (10) to hold the barbell in position on a front his/her shoulders, preferably on the deltoids. Further, during squatting, the tight hold of the exerciser on handle support device (10)

enables the exerciser to more comfortably position his/her elbows while executing the lift.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A handle support device for a barbell shaft, comprising:

a handle comprising a first end and a second end, wherein the first end extends into a U-shaped sleeve, the second end comprises a lip;

wherein the first end and the second end are at a pre-defined distance from each other;

wherein the U-shaped sleeve is configured to releasably lock onto an outer periphery of the barbell shaft such that the handle extends in a lateral direction relative to the longitudinal axis of the barbell shaft when the handle is locked on the barbell shaft;

wherein the U-shaped sleeve comprises a snap lock provided towards a free end to releasably lock the U-shaped sleeve onto the barbell shaft; and wherein the snap lock is formed as a protrusion on the free end protruding inwards towards a curvature of the U-shaped sleeve.

2. The handle support device of claim 1, further including an inner metal frame, wherein the inner metal frame has a first end comprising one or more claws extending towards a free end.

3. The handle support device of claim 2, wherein the inner metal frame is covered by a semi-soft material configured to be gripped by a user.

4. The handle support device of claim 3, wherein the inner metal frame includes a second end covered by a semi-soft material to form a grip for a user.

5. The handle support device of claim 4, wherein the grip is selected from the group consisting of a finger grip, a ribbed grip, a bubble grip, a hex grip, and a contour grip.

6. The handle support device of claim 5, wherein the grip comprises a text area including a text embossed on a surface of the grip.

7. The handle support device of claim 1, wherein the U-shaped sleeve has a curvature with an inner diameter between 23-30 millimeters.

8. The handle support device of claim 7, wherein the inner diameter of the curvature of the U-shaped sleeve is expandable up to 30 millimetres in the locked position.

9. The handle support device of claim 1, wherein the pre-defined distance is between 140 and 160 millimetres.

10. A handle support device for a barbell shaft, comprising:

two handles configured to releasably lock onto an outer periphery of the barbell shaft, such that the two handles extend laterally from the barbell shaft relative to a longitudinal axis of the barbell shaft when the two handles are locked on the barbell shaft;

each of the two handles comprising a first end and a second end with a length extending therebetween, wherein the first end extends into a U-shaped sleeve, the second end comprises a lip, and the length is a pre-defined distance;

whereby a user can grip the two handles when the two handles are locked on the barbell shaft;

wherein the U-shaped sleeve on each handle comprises a snap lock provided towards a free end to releasably lock the U-shaped sleeve onto the barbell shaft; and wherein the snap lock on each handle is formed as a protrusion on the free end protruding inwards towards a curvature of the U-shaped sleeve.

11. The handle support device of claim 10, wherein each handle further includes an inner metal frame, wherein the inner metal frame has a first end comprising one or more claws extending towards a free end.

12. The handle support device of claim 11, wherein the inner metal frame is covered by a semi-soft material configured to be gripped by a user.

13. The handle support device of claim 12, wherein the inner metal frame includes a second end covered by a semi-soft material to form a grip for a user.

14. The handle support device of claim 13, wherein the grip is selected from the group consisting of a finger grip, a ribbed grip, a bubble grip, a hex grip, and a contour grip.

15. The handle support device of claim 14, wherein the grip comprises a text area including a text embossed on a surface of the grip.

16. The handle support device of claim 10, wherein the U-shaped sleeve on each handle has a curvature with an inner diameter between 23-30 millimeters.

* * * * *